US007980429B2

(12) United States Patent
Patey et al.

(10) Patent No.: US 7,980,429 B2
(45) **Date of Patent: *Jul. 19, 2011**

(54) METHOD AND APPARATUS FOR DISPENSING PASTE-LIKE SUBSTANCES

(75) Inventors: Darrin Bentley Patey, Brampton (CA); Sergio Octavio Montero Orozco, Mexico City (MX); Diego Javier Moreno Cureño, Mexico City (MX)

(73) Assignee: Sabritas, S. de R.L. de C.V., Col Bosques de las Lomas (MX)

( * ) Notice: Subject to any disclaimer, the term of this patent is extended or adjusted under 35 U.S.C. 154(b) by 0 days.

This patent is subject to a terminal disclaimer.

(21) Appl. No.: 12/301,386

(22) PCT Filed: Jun. 22, 2007

(86) PCT No.: PCT/MX2007/000077

§ 371 (c)(1),
(2), (4) Date: Apr. 7, 2009

(87) PCT Pub. No.: WO2008/094028

PCT Pub. Date: Aug. 7, 2008

(65) Prior Publication Data

US 2009/0302070 A1 Dec. 10, 2009

Related U.S. Application Data

(63) Continuation-in-part of application No. 11/669,335, filed on Jan. 31, 2007, now Pat. No. 7,717,304.

(51) Int. Cl.
*G01F 11/00* (2006.01)

(52) U.S. Cl. ..... 222/405; 222/129

(58) Field of Classification Search ..... 222/390, 222/144, 145, 142.5, 142.8, 142.9, 145.3, 222/143, 5, 129, 386, 340, 325–327, 405, 222/564, 522

See application file for complete search history.

(56) References Cited

U.S. PATENT DOCUMENTS

| | | | | | |
|---|---|---|---|---|---|
| 3,093,272 | A | * | 6/1963 | Esthus | 222/480 |
| 3,128,765 | A | * | 4/1964 | Tint | 604/193 |
| 3,472,423 | A | | 10/1969 | Kaplan | |
| 3,684,136 | A | * | 8/1972 | Baumann | 222/386 |
| 3,901,416 | A | | 8/1975 | Schultz | |
| 4,074,833 | A | | 2/1978 | Otto, Sr. | |
| 4,083,477 | A | * | 4/1978 | Zetterberg | 222/386 |
| 4,189,065 | A | | 2/1980 | Herold | |
| 4,213,456 | A | * | 7/1980 | Bottger | 604/226 |
| 4,323,177 | A | | 4/1982 | Nielsen | |
| 4,371,094 | A | | 2/1983 | Hutter, III | |
| 4,648,532 | A | | 3/1987 | Green | |
| 4,714,205 | A | * | 12/1987 | Steinko | 241/95 |
| 4,810,249 | A | * | 3/1989 | Haber et al. | 604/210 |
| 5,000,736 | A | * | 3/1991 | Kaufhold et al. | 604/110 |
| 5,105,985 | A | * | 4/1992 | Kroeber | 222/107 |

(Continued)

*Primary Examiner* — Lien T Ngo
(74) *Attorney, Agent, or Firm* — Colin P. Cahoon; Amanda K. Jenkins; Carstens & Cahoon, LLP

(57) ABSTRACT

The present invention discloses a container having a cavity for dispensing a paste and a cavity for another material. In one aspect, a first cavity for a comestible paste resides in an area between a hollow piston and a top section having a dispenser. The top section and piston optionally have corresponding male and female threads in their respective cylindrical sections. The paste can be dispensed by slidably advancing the piston towards the dispenser. In an optional embodiment, the threads can then be engaged to rotatably advance the piston towards the dispenser to dispense additional paste. A comestible seasoning or other material can be disposed in the hollow piston.

12 Claims, 4 Drawing Sheets

U.S. PATENT DOCUMENTS 5,125,898 A * 6/1992 Kaufhold et al. ..... 604/110
5,165,572 A 11/1992 Bath
5,232,447 A * 8/1993 Schwarz et al. ..... 604/110
5,650,180 A 7/1997 Kumada
5,718,357 A 2/1998 Dang
6,247,995 B1 6/2001 Bryan
6,477,743 B1 11/2002 Gross
6,513,680 B2 2/2003 Nakayoshi
6,869,284 B2 3/2005 Aoyagi
6,935,543 B2 8/2005 DeGroot

* cited by examiner

METHOD AND APPARATUS FOR DISPENSING PASTE-LIKE SUBSTANCES

CROSS-REFERENCE TO RELATED APPLICATIONS

This patent application is a national stage patent application filed under 35 U.S.C. §371, claiming priority to International Serial No. PCT/MX2007/000077, filed on Jun. 22, 2007, which claims the benefit of U.S. Ser. No. 11/669,335, filed on Jan. 31, 2007, entitled "Method and Apparatus for Dispensing Paste-Like Substances," the technical disclosure of which is hereby incorporated by reference.

This application is also being filed as a continuation-in-part of co-pending U.S. Ser. No. 11/669,335, filed on Jan. 31, 2007, entitled "Method and Apparatus for Dispensing Paste-Like Substances," the technical disclosure of which is hereby incorporated by reference.

STATEMENT REGARDING FEDERALLY SPONSORED RESEARCH OR DEVELOPMENT

Not Applicable

THE NAMES OF THE PARTIES TO A JOINT RESEARCH AGREEMENT

Not Applicable

INCORPORATION-BY-REFERENCE OF MATERIAL SUBMITTED ON A COMPACT DISC

Not Applicable

BACKGROUND OF THE INVENTION

1. Technical Field

The present invention relates to an apparatus and method for dispensing a paste-like substance from a first cavity and can optionally dispense another substance from a second cavity.

2. Description of Related Art

Piston-based dispensing containers are known in the art. For example, Kaplan (U.S. Pat. No. 3,472,423) discloses a compartmentalized dispensing container capable of dispensing a plurality of independently stored substances in such a manner so as to homogenously administer the substances. Nielsen (U.S. Pat. No. 4,323,177) discloses a tube-shaped container with an inner piston. An axial force is provided by a piston rod. Otto, Sr. (U.S. Pat. No. 4,074,833) discloses a tube-shaped container having a conical-shaped end and a conically-shaped piston. A threaded rod is coaxially aligned with the longitudinal axis of the container and through the center of the piston. One end of the threaded rod is secured to a knob, which when turned creates a rotationally-generated axial force that causes a circular member to advance thereby dispensing the contents.

While the prior art discloses a piston for ejecting a paste-like material from a container, the prior art fails to disclose a container that can be used to store another non-paste like material such as a powdered or granular food topping that can be dispensed separately from the paste material. The prior art also fails to disclose a container that permits a paste to be first dispensed by direct application of an axial force to the piston followed by an axial force generated by rotation.

SUMMARY OF THE INVENTION

In one aspect, the proposed invention is a container having a first cavity for ejecting a food-based paste and a second cavity for a seasoning. The container comprises a hollow piston having a cone-shaped end and a cylindrical end-cap receiving end. A larger, similarly shaped top section having a cone-shaped section with a dispenser is adapted to encapsulate the cone-shaped portion of the hollow piston. A region of the piston encapsulated between the top section and the cone-shaped portion of the hollow piston defines a first cavity for a paste.

In one aspect, a recessed endcap having one or more removable sections engages the cylindrical end of the hollow piston defining a second cavity therein. A rotatable piston spinner having one or more openings can be attached to the endcap. Upon removing the removable sections of the endcap, the piston spinner can be rotated to permit or prevent the release of contents from the second cavity. The outer perimeter of the top section can comprise a pair of flange members to facilitate dispensing of the paste that occurs by slidably advancing the piston towards the dispenser. To maximize the amount of paste dispensed from the container, the hollow piston can optionally comprise a set of threads about the outer periphery that are adapted to receive a corresponding set of threads disposed on the inner periphery of the top section once the piston has slidably advanced a pre-determined distance into the top section. The remaining paste is then forced through the dispenser by twisting the engaged threaded sections to rotatably advance the piston. The above as well as additional features and advantages of the present invention will become apparent in the following written detailed description.

BRIEF DESCRIPTION OF THE DRAWINGS

The novel features believed characteristic of the invention are set forth in the appended claims. The invention itself, however, as well as a preferred mode of use, further objectives and advantages thereof, will be best understood by reference to the following detailed description of illustrative embodiments when read in conjunction with the accompanying drawings, wherein:

DETAILED DESCRIPTION

Figure 1:
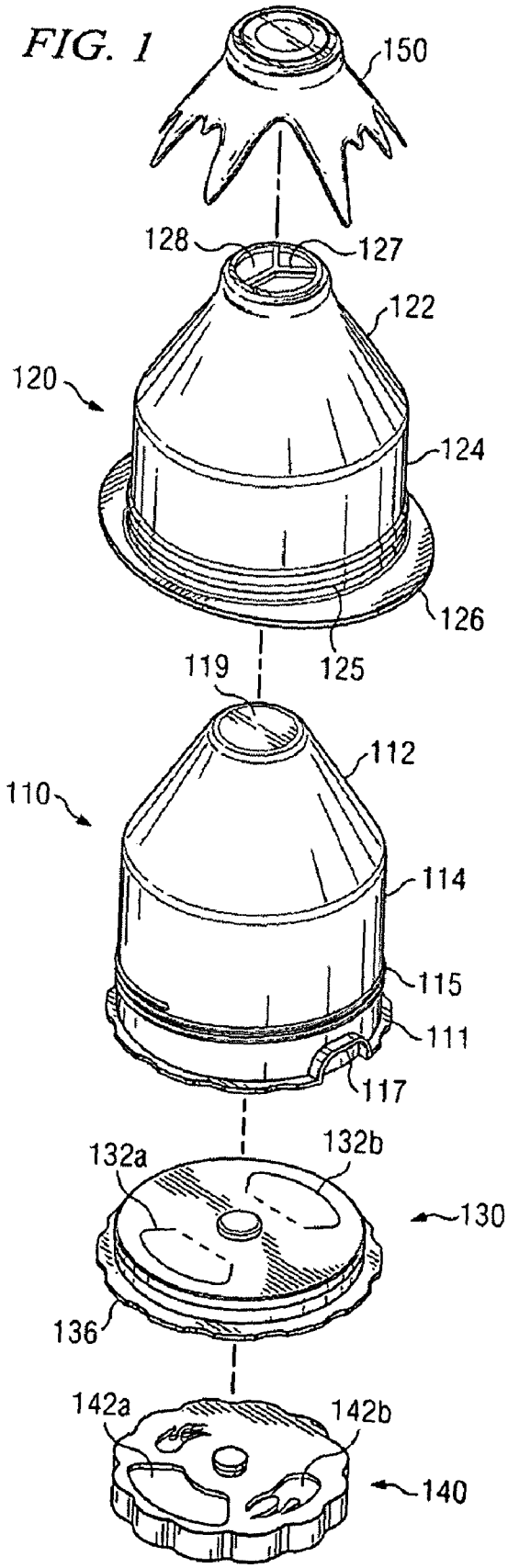
FIG. 1 is an exploded view of the dual-compartment paste dispensing container in accordance with one embodiment of the present invention.

FIG. 1 is an exploded view of the dual-compartment paste dispensing container in accordance with one embodiment of the present invention. As used herein, like numerals indicate like elements throughout the specification. As shown in FIG. 1, the container comprises a hollow piston 110 comprising a cone-shaped portion 112 that terminates as a plane 119 at the narrow end and a cylindrical section 114 that terminates at a piston flange 111. In one embodiment, the plane 119 is parallel to the dispenser 128. In the embodiment shown, the piston 110 comprises male outer threads 115 about the outer periphery of the piston 110. Similarly, the top section 120 comprises female inner threads 125 designed to threadably engage the male threads 115. The outer male threads 115 and inner female threads 125 are optional and, in one embodiment, the piston 110 comprises a cylindrical section 114 having no male or female threads. Similarly, in one embodiment, the top section 120 comprises a cylindrical section 124 having no male or female threads. The piston 110 is sized such that the piston 110 can slidably engage the top section 120 and slidably advance the piston 110 towards the dispenser 128. In the embodiment shown, once the piston 110 has advanced towards the dispenser 128 a pre-determined distance, the piston 110 and top section 120 can threadably engage via the external threads 115 on the piston 110 and the inner threads 125 on the top section 120. The piston 110 and/or top section 120 can then be twisted to rotatably advance the piston 110 towards the dispenser 128. As used herein, the term "pre-determined distance" is the length of the cylindrical section 114 from the top external thread 115 to the largest diameter of the cone-shaped portion 112.

Similar to the hollow piston 110, the top section 120 comprises a cone-shaped section 122 and a cylindrical section 124. In one embodiment, the top section 120 comprises an outwardly extending flange 126 about the circumference near the terminal end of the cylindrical section 124. The outwardly extending flange 126 can reside anywhere on the cylindrical section 124 of the top section 120. For example, in the embodiment shown, the outwardly extending flange 126 is located below the inner threads 125 at the terminal end of the cylindrical section 124. In an alternative embodiment (not shown), the outwardly extending flange is located between the inner threads 125 and the cone-shaped section 122.

The cone-shaped section 122 comprises a dispenser 128 at the narrow, terminal end of the top section 120. In one embodiment, the dispenser 128 comprises one or more spokes 127. Spokes 127 can be used provide additional rigidity to the dispenser 128. A snap-fit or threaded removable cap 150 can be used to cover the dispenser 128. In the embodiment shown, the removable cap 150 is decorative in nature and resembles a lava flow from a volcano. Other decorative or non-decorative caps can be used in other embodiments.

The endcap 130 comprises one or more scored, removable openings 132*a* 132*b*. In one embodiment, the endcap 130 comprises an endcap flange 136 about its circumferential periphery, which helps to facilitate the endcap 130 being press-fit into the hollow piston 110. Consequently, when then endcap 130 is disposed in the hollow piston 110, the endcap flange 136 mates with the piston flange 111. A rotatable piston spinner 140 having one or more openings 142*a* 142*b* can be attached to the endcap 130. In one embodiment, the piston spinner 140 is snap-fit to the endcap 130.

Figure 2:
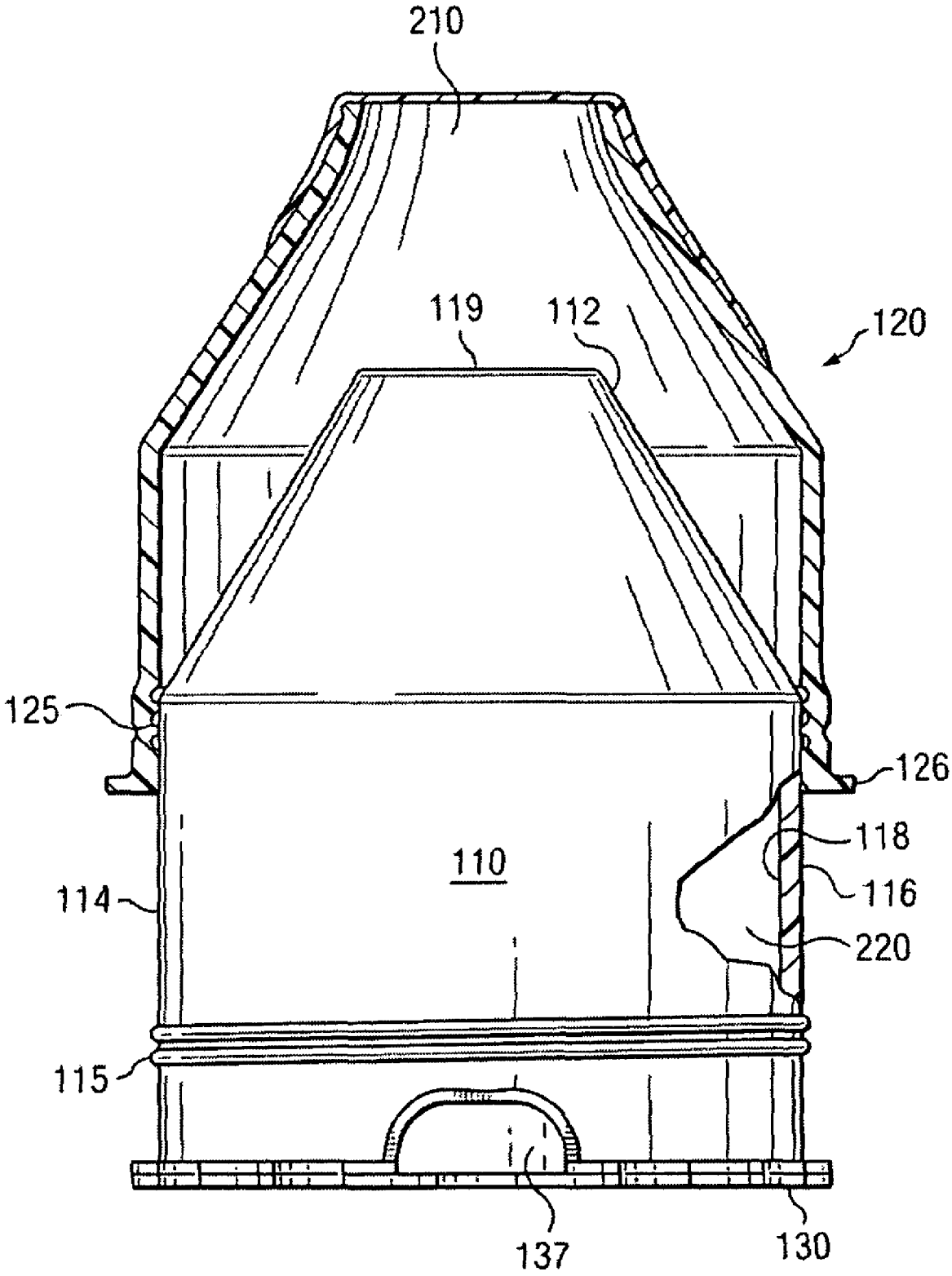
FIG. 2 is a cross-sectional side view of the dual-compartment paste dispensing container depicted in FIG. 1.

FIG. 2 is a cross-sectional side view of the dual-compartment paste dispensing container depicted in FIG. 1. The top section 120 slidably engages about the outer periphery 116 of the piston 110 to form a first cavity 210. The first cavity 210 is defined by the area between the cone-shaped portion 112 of the hollow piston 110 and the top section 120. The first cavity 210 can be used for storing a paste-like substance. As used herein the terms "paste" and "paste-like substance" are synonymous and are used interchangeably. As used herein, a paste-like substance is used to define materials which have viscosity and flow characteristics which are comparable with those of a non-Newtonian fluid. Examples of paste-like substances include, but not limited to cheese spread, cream cheese, peanut butter, fruit paste, frostings, glazes, and doughs.

In one embodiment, a second cavity 220 exists in the hollow piston 110 and is defined by the area within the inner periphery 118 of the hollow piston 110 and the endcap 130. A powdery or granular-like substance including, but not limited to, sugar, ground nuts, decorative sprinkles, herbs, spices, and salt can be placed into the second cavity 220. Alternatively, a non-granular material can be stored in the second cavity 220 and a user can use the thumb hole 137 to easily remove the endcap 130 and access the material. The material in the second cavity 220 can be any material and is preferably a material that complements the material in the first cavity 210. For example, peanut butter can be the paste-like material in the first cavity and jelly can be placed in the second cavity 220. Although many embodiments of the present invention utilize a piston 110 that is hollow, such embodiment is only necessary if a second cavity 220 is desired.

Referring to FIGS. 1 and 2, to dispense paste in the first cavity 210 shown in FIG. 2, a user's thumbs can be placed opposite one another on the endcap flange 136 while the user's index fingers are placed on the top section 120 outwardly extending flange 126. In this configuration, the operator can then slidably advance the piston 110 towards the dispenser 128 to dispense the paste. As the thumbs and index fingers approach one another as the piston 110 is slidably advanced towards the dispenser 128, the angle between the index fingers and the thumbs decreases, and it becomes more difficult for the user to provide the requisite force to slidably advance the piston 110. Consequently, in one embodiment, once the piston 110 has slidably advanced a pre-determined distance, the inner threads 125 can engage the outer threads 115 and the piston can be twisted to rotatably advance the piston 110 towards the dispenser until the cone shaped section 112 of the piston 110 approaches the cone-shaped section 122 of the top section 120. Such design advantageously dispenses more of the paste-like substance from the first cavity 210 than could be otherwise dispensed without the threads 115, 125. In one embodiment, the piston 110 and top section 120 do not have threads.

Figure 3:
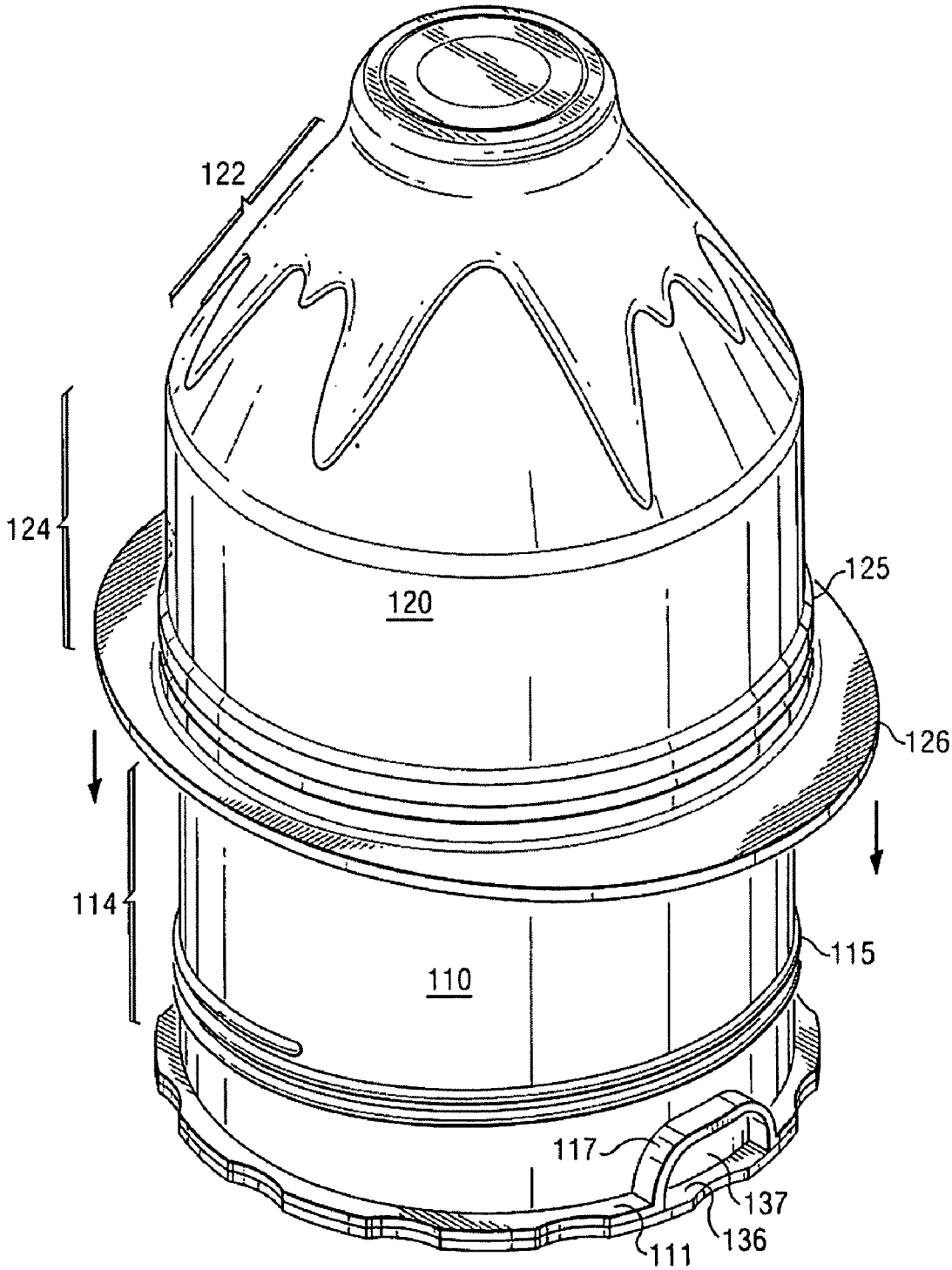
FIG. 3 is a top perspective view of the dual-compartment paste dispensing container in accordance with one embodiment of the present invention.
Figure 4:
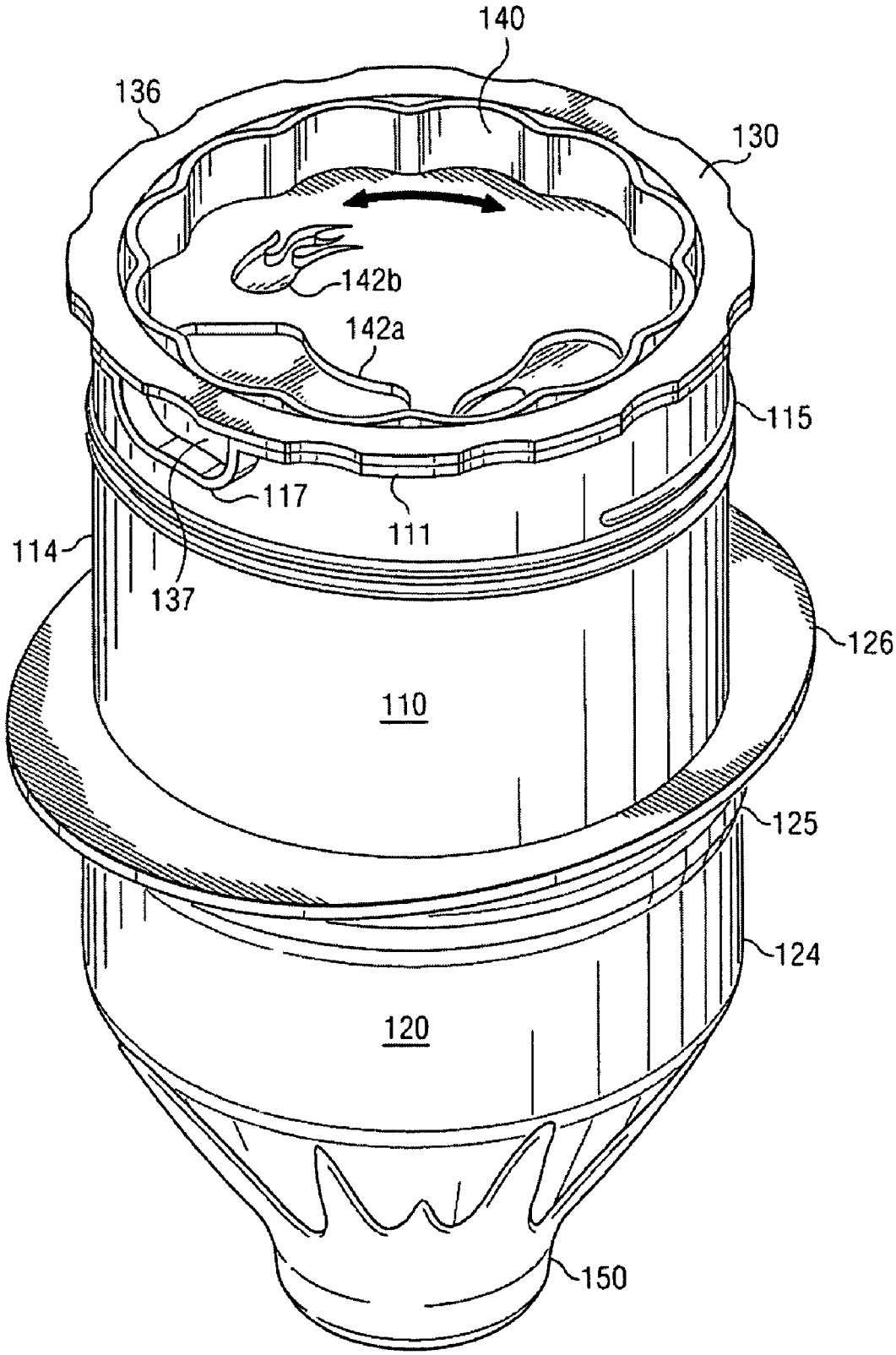
FIG. 4 is a bottom perspective view of the dual-compartment paste dispensing container depicted in FIG. 3.

FIG. 3 is a top perspective view of the dual-compartment paste dispensing container in accordance with one embodiment of the present invention. FIG. 4 is a bottom perspective view of the dual-compartment paste dispensing container depicted in FIG. 3. Referring to FIG. 3 and FIG. 4, in one embodiment, the piston flange 111 comprises an arch 117 to create a thumb hole 137 that allows the consumer to press down on and remove the endcap flange 136. Such embodiment can facilitate re-fill of the second cavity. In one embodiment, as best depicted by FIG. 4, the piston spinner 140 can freely rotate in the clockwise or counterclockwise position as shown by the arrows to reveal a removable opening (not visible) on the endcap 130 below. Thus, the piston spinner 140 can be rotated as desired to permit or prevent the release of contents from the second cavity.

In one embodiment, the present invention comprises a method for dispensing a paste-like substance. To dispense the paste, the dispenser 128 is slidably advanced a pre-determined distance down the cylindrical section 114 of the hollow piston 110 in the direction indicated by the arrows depicted in FIG. 3. In one embodiment, the internal threads 125 and the external threads 115 are threadably engaged, and the piston 110 and top section 120 are twisted to rotatably advance the piston and dispense additional paste.

There are several advantages provided by the present invention. One advantage is that the pre-determined distance can be varied as desired. For example, if a relatively high viscosity paste (e.g. a paste that is not easily dispensed) is used in the first cavity, it may only be possible for a person to slidably advance the piston for a short distance. The present invention, however, permits the pre-determined distance that the piston is slidably advanced to be shortened to compensate for this scenario. Thus, in one embodiment, the pre-determined distance can be relatively short and a majority of the piston movement can occur by twisting the top section and piston after the threaded sections have been engaged. Consequently, the present invention can be used to permit people to dispense high viscosity pastes that are resistant to flow. Further, in one embodiment, the pre-determined distance can be adjusted to permit the elderly or young children to better dispense a paste-like substance from a container.

Another advantage of the present invention is that because there is no axial member within the hollow piston, the hollow piston can be used to as a second cavity to store a granular food topping that can be dispensed separately from the paste material. In one embodiment, the present invention, the first cavity can be used to store a fruit paste and the second cavity can be used to store a colored or uncolored sugar-based topping.

While this invention has been particularly shown and described with reference to a preferred embodiment, it will be understood by those skilled in the art that various changes in form and detail may be made therein without departing from the spirit and scope of the invention.

We claim:

1. A dual-compartment container for dispensing a paste-like composition comprising:

a hollow piston (110), wherein said hollow piston (110) comprises a cone-shaped portion (112) and a cylindrical portion (114) having an outer periphery (116) and an endcap (130), wherein said endcap (130) is recessed in said hollow piston (110);

a top section (120) adapted to slidably engage about said outer periphery (116) of said hollow piston (110), said top section (120) having a dispenser (128) wherein said dispenser (128) is an opening having an internal rim in said top section (120) at the end of said top section (120) proximal to said cone-shaped end (112) of said hollow piston (110), further wherein said dispenser (128) comprises a plurality of spokes (127) extending from said internal rim of said opening and converging in the middle of said opening;

a first cavity (210) defined by said cone-shaped end (112) of said hollow piston (110) and said top section (120); and a second cavity (220) defined by an inner periphery (118) of said hollow piston (110) and said endcap (130).

2. The container of claim 1 wherein said top section (120) comprises a cone-shaped section (122) adjacent said dispenser (128).

3. A container for dispensing a paste-like composition comprising:

a piston (110), wherein said piston (110) comprises:

a cylindrical portion (114);

a cone-shaped portion (112) adjacent said cylindrical portion (114);

an endcap (130) recessed in said cylindrical portion (114); and a top section (120) adapted to slidably engage about said outer periphery (116) of said hollow piston (110), said top section (120) having a dispenser (128) wherein said dispenser (128) is an opening having an internal rim in said top section (120) at the end of said top section (120) proximal to said cone-shaped end (112) of said hollow piston (110), further wherein said dispenser (128) comprises a plurality of spokes (127) extending from said internal rim of said opening and converging in the middle of said opening, and further wherein said top section (120) further comprises an outer flange (112).

4. The container of claim 3 wherein a first cavity (210) is defined by a cone-shaped end (112) of said piston (110) and said top section (120) and further wherein said endcap (130) is disposed within said cylindrical portion (114) of said piston (110) thereby defining a second cavity (220) within said piston (110).

5. The container of claim 4 wherein said piston (110) comprises a hollow piston (110).

6. The container of claim 4 wherein said endcap (130) comprises one or more removable openings (132*a*).

7. The container of claim 4 further comprising a piston spinner (140) rotatably attached to said endcap (130).

8. The container of claim 7 wherein said piston spinner (140) comprises one or more openings (142*a*).

9. The container of claim 3 wherein said top section (120) comprises a cone-shaped section (122) adjacent said dispenser.

10. The container of claim 1 wherein said endcap (130) comprises one or more removable openings (132*a*).

11. The container of claim 1 further comprising a piston spinner (140) rotatably attached to said endcap (130).

12. The container of claim 11 wherein said piston spinner (140) comprises one or more openings (142*a*).

* * * * *